US009376915B2

(12) United States Patent
Kobayashi et al.

(10) Patent No.: US 9,376,915 B2
(45) Date of Patent: Jun. 28, 2016

(54) AIR MOTOR AND ELECTRIC PAINTING DEVICE

(75) Inventors: Naoya Kobayashi, Fujisawa (JP); Tsuyoshi Nakamura, Fujisawa (JP); Yuu Koiwa, Fujisawa (JP)

(73) Assignee: NSK Ltd., Tokyo (JP)

( * ) Notice: Subject to any disclaimer, the term of this patent is extended or adjusted under 35 U.S.C. 154(b) by 38 days.

(21) Appl. No.: 13/504,397

(22) PCT Filed: Nov. 28, 2011

(86) PCT No.: PCT/JP2011/006614

§ 371 (c)(1),
(2), (4) Date: Apr. 26, 2012

(87) PCT Pub. No.: WO2012/073475

PCT Pub. Date: Jun. 7, 2012

(65) Prior Publication Data

US 2014/0217205 A1 Aug. 7, 2014

(30) Foreign Application Priority Data

Nov. 29, 2010 (JP) ..... 2010-265645

(51) Int. Cl.
*B05B 5/03* (2006.01)
*F01D 1/02* (2006.01)
(Continued)

(52) U.S. Cl.
CPC ..... *F01D 1/026* (2013.01); *B05B 3/002* (2013.01); *B05B 5/03* (2013.01); *B05B 5/0415* (2013.01); *F01D 1/023* (2013.01); *F01D 1/06* (2013.01)

(58) Field of Classification Search
CPC ..... B05B 5/0415; B05B 5/0407
USPC ..... 239/690–700; 415/202, 229; 384/100, 384/107
See application file for complete search history.

(56) References Cited

U.S. PATENT DOCUMENTS 5,660,480 A * 8/1997 Fujii et al. ..... 384/107
7,131,601 B2 * 11/2006 Nolte et al. ..... 239/224
(Continued)

FOREIGN PATENT DOCUMENTS

JP 8-117245 A 5/1996
JP 9-262509 A 10/1997
(Continued)

OTHER PUBLICATIONS

Yukio Tomita., "Hydrodynamics", Introduction to and Structure of Fluid Flow Phenomena, Published by Jikkyo Shuppnan Co., Ltd., Mar. 28, 1982, including English-language translation (eleven (11) pages).
(Continued)

*Primary Examiner* — Len Tran
*Assistant Examiner* — Tuongming Pham
(74) *Attorney, Agent, or Firm* — Crowell & Moring LLP

(57) ABSTRACT

An air motor and an electric painting device improves driving efficiency, and includes a housing, a main shaft inserted inside of the housing, an impeller fixed concentrically with the main shaft to an inserted portion of the main shaft and having a plurality of turbine blades formed on the outer periphery, bearings for rotatably supporting the main shaft and the impeller, and a nozzle having a tubular or hole-shaped channel for ejecting compressed air to the respective turbine blades for rotating the impeller along the circumference. When $M_1=v_e/a_0$ where $v_e$ denotes flow velocity of the compressed air in an entrance of the channel of the nozzle, and $a_0$ denotes acoustic velocity, the length of the channel of the nozzle is set to a dimension of a calculated value or greater using a predetermined expression.

7 Claims, 8 Drawing Sheets

(51) Int. Cl.

| | |
|---|---|
| ***F01D 1/06*** | (2006.01) |
| ***B05B 3/00*** | (2006.01) |
| ***B05B 5/04*** | (2006.01) |

(56) References Cited

U.S. PATENT DOCUMENTS

| | | | | |
|---|---|---|---|---|
| 7,322,793 | B2 * | 1/2008 | Baumann et al. | 415/202 |
| 7,967,552 | B2 | 6/2011 | Brett et al. | |
| 8,038,385 | B2 * | 10/2011 | Kawai et al. | 415/80 |
| 8,162,544 | B2 * | 4/2012 | Hirata | 384/100 |
| 2006/0239845 | A1 | 10/2006 | Yamamoto et al. | |
| 2007/0257131 | A1 * | 11/2007 | Brett et al. | 239/223 |
| 2011/0044810 | A1 * | 2/2011 | Ions | 415/229 |
| 2011/0158803 | A1 * | 6/2011 | Sebald et al. | 415/229 |

FOREIGN PATENT DOCUMENTS

| | | | |
|---|---|---|---|
| JP | 11-289713 | A | 10/1999 |
| JP | 2000-33292 | A | 2/2000 |
| JP | 2005-48605 | A | 2/2005 |
| JP | 2006-194203 | A | 7/2006 |
| JP | 2006-300024 | A | 11/2006 |
| JP | 2008-57363 | A | 3/2008 |
| JP | 2008-511432 | A | 4/2008 |
| JP | 2009-243461 | A | 10/2009 |

OTHER PUBLICATIONS

Computer-generated English-translation of reference B2 (JP 2009-243461A) previously filed on Apr. 26, 2012 (nine (9) pages).

International Search Report dated Dec. 20, 2011 including English-language translation (Four (4) pages).

International Preliminary Report on Patentability (PCT/IB/338 & PCT/IB/373), including Written Opinion (PCT/ISA/237) dated Jun. 13, 2013 (seven (7) pages).

Yasuo Mori, et al., "Introduction to Thermodynamics", Yokendo Co., Ltd., 2001, pp. 208-217, (The 25$^{th}$ Edition of which published in 1989). pp. 213-214 of this document were previously submitted as C1 on Apr. 26, 2012.

Chinese Office Action dated May 6, 2014 including English translation (Twelve (12) pages).

Yasuo Mori, et al., "Introduction to Thermodynamics", Revised Edition, Yokendo, Co., Ltd., 1989, (nine (9) pages including English translation).

Japanese Office Action Dated May 28, 2013 and English translation thereof {Six (6) Pages}.

* cited by examiner

FLOW RATE 20 [NL/min]
NOZZLE DIAMETER 1.1 [mm]
L 0.34 [mm]

| NOZZLE LENGTH | NOZZLE LENGTH/ L | SUPPLY PRESSURE | RATE (SUPPLY PRESSURE RATIO) |
|---|---|---|---|
| 0.34 | 1.0 | 0.24 | 1.37 |
| 1.50 | 4.4 | 0.19 | 1.10 |
| 1.70 | 5.0 | 0.19 | 1.08 |
| 3.40 | 10.0 | 0.18 | 1.02 |
| 5.10 | 15.0 | 0.18 | 1.00 |
| 5.60 | 16.5 | 0.18 | 1.00 |
| 6.80 | 20.0 | 0.18 | 1.00 |
| 8.50 | 25.0 | 0.18 | 1.01 |
| 13.60 | 40.0 | 0.19 | 1.05 |

*FIG. 4*

FLOW RATE 50 [NL/min]
NOZZLE DIAMETER 1.1 [mm]
L 0.40 [mm]

| NOZZLE LENGTH | NOZZLE LENGTH/ L | SUPPLY PRESSURE | RATE (SUPPLY PRESSURE RATIO) |
|---|---|---|---|
| 0.40 | 1.0 | 0.61 | 1.37 |
| 1.80 | 4.5 | 0.48 | 1.10 |
| 2.00 | 5.0 | 0.48 | 1.08 |
| 4.00 | 10.0 | 0.45 | 1.02 |
| 6.00 | 15.0 | 0.44 | 1.00 |
| 6.40 | 16.0 | 0.44 | 1.00 |
| 8.00 | 20.0 | 0.44 | 1.00 |
| 10.00 | 25.0 | 0.45 | 1.01 |
| 12.00 | 30.0 | 0.45 | 1.02 |
| 16.00 | 40.0 | 0.46 | 1.05 |

*FIG. 5*

FLOW RATE 50 [NL/min]
NOZZLE DIAMETER 1.8 [mm]
L 0.59 [mm]

| NOZZLE LENGTH | NOZZLE LENGTH/ L | SUPPLY PRESSURE | RATE (SUPPLY PRESSURE RATIO) |
|---|---|---|---|
| 0.59 | 1.0 | 0.23 | 1.38 |
| 2.60 | 4.4 | 0.18 | 1.10 |
| 2.95 | 5.0 | 0.18 | 1.09 |
| 5.90 | 10.0 | 0.17 | 1.02 |
| 8.85 | 15.0 | 0.16 | 1.00 |
| 10.10 | 17.1 | 0.16 | 1.00 |
| 11.80 | 20.0 | 0.16 | 1.00 |
| 14.75 | 25.0 | 0.17 | 1.01 |
| 23.60 | 40.0 | 0.17 | 1.05 |

*FIG. 6*

FLOW RATE 150 [NL/min]
NOZZLE DIAMETER 1.8 [mm]
L 0.74 [mm]

| NOZZLE LENGTH | NOZZLE LENGTH/ L | SUPPLY PRESSURE | RATE (SUPPLY PRESSURE RATIO) |
|---|---|---|---|
| 0.74 | 1.0 | 0.68 | 1.37 |
| 3.30 | 4.5 | 0.54 | 1.10 |
| 3.70 | 5.0 | 0.54 | 1.09 |
| 7.40 | 10.0 | 0.50 | 1.02 |
| 11.10 | 15.0 | 0.49 | 1.00 |
| 12.60 | 17.0 | 0.49 | 1.00 |
| 14.80 | 20.0 | 0.49 | 1.00 |
| 18.50 | 25.0 | 0.50 | 1.01 |
| 22.20 | 30.0 | 0.50 | 1.02 |
| 29.60 | 40.0 | 0.52 | 1.05 |

*FIG. 7*

FLOW RATE 150 [NL/min]
NOZZLE DIAMETER 2.5 [mm]
L 1.00 [mm]

| NOZZLE LENGTH | NOZZLE LENGTH/ L | SUPPLY PRESSURE | RATE (SUPPLY PRESSURE RATIO) |
|---|---|---|---|
| 1.00 | 1.0 | 0.35 | 1.36 |
| 4.40 | 4.4 | 0.28 | 1.10 |
| 5.00 | 5.0 | 0.28 | 1.08 |
| 10.00 | 10.0 | 0.26 | 1.01 |
| 15.00 | 15.0 | 0.26 | 1.00 |
| 16.20 | 16.2 | 0.26 | 1.00 |
| 20.00 | 20.0 | 0.26 | 1.00 |
| 25.00 | 25.0 | 0.26 | 1.01 |
| 40.00 | 40.0 | 0.27 | 1.06 |

*FIG. 8*

FLOW RATE 300 [NL/min]
NOZZLE DIAMETER 2.5 [mm]
L 1.10 [mm]

| NOZZLE LENGTH | NOZZLE LENGTH/ L | SUPPLY PRESSURE | RATE (SUPPLY PRESSURE RATIO) |
|---|---|---|---|
| 1.10 | 1.0 | 0.71 | 1.37 |
| 4.90 | 4.5 | 0.56 | 1.10 |
| 5.50 | 5.0 | 0.56 | 1.08 |
| 11.00 | 10.0 | 0.52 | 1.02 |
| 16.50 | 15.0 | 0.51 | 1.00 |
| 18.70 | 17.0 | 0.51 | 1.00 |
| 22.00 | 20.0 | 0.51 | 1.00 |
| 27.50 | 25.0 | 0.52 | 1.01 |
| 33.00 | 30.0 | 0.52 | 1.02 |
| 44.00 | 40.0 | 0.54 | 1.05 |

AIR MOTOR AND ELECTRIC PAINTING DEVICE

TECHNICAL FIELD

The present invention relates to an air motor mounted on a spindle device that is used in an electric painting process, or on a drive member of a spindle system for a machine tool, which uses small tools in diameter needed for high velocity revolution, for example, and an electric painting device.

BACKGROUND ART

The air motor is an engine for rotating a main shaft by having the main shaft supported by static pressure gas bearings, and ejecting a gas such as compressed air toward an impeller (rotor blade) from a nozzle (holes and tubes), and is widely used, mounted on electric painting devices, high-precision machine tools, and similar devices. Various modifications of conventional devices have been made so as to improve rotation efficiency, and various motor configurations as concrete examples thereof are well-known (See Patent Document 1 and Patent Document 2).

FIGS. 1 and 2 illustrate a configuration of an air motor (spindle device with air turbine) mounted on an electrostatic spray gun of an electric painting device as a configuration example of such an air motor. This air motor includes a hollow main shaft 2, which extends in an approximately right circular tube form from a base to a tip (from right end to left end in FIG. 1), and an impeller 4, which is arranged on the base of the main shaft 2 concentric therewith. The impeller 4 includes a annular portion 6, which is a larger flat plate in diameter than the main shaft 2 and is positioned and fixed to the base of the main shaft 2 by a fastening member or the like, and an impeller main body 8, which is a short cylinder that is larger in diameter than the main shaft and smaller in diameter than the annular portion 6 and is fixed on an axial side (right side in FIG. 1) of the annular portion 6. Multiple turbine blades 10 are formed across the entire impeller main body 8 at equal intervals along the circumference thereof. Each of the turbine blades 10 is structured with the same form so as to have the same gradient (for example, forward tilting in normal rotative direction (right rotative direction C in FIG. 2) of the impeller 4) in the same rotative direction.

The main shaft 2 and the impeller 4 making such a structure are rotatably supported by predetermined bearings (radial static pressure gas bearings 14 and axial static pressure gas bearings 16) in a housing 12, respectively. In the structure shown in FIG. 1, a bearing main unit 18 of the radial static pressure gas bearings 14 is made of a porous material in cylindrical form, fixed at a central portion along the axis inside of the housing 12, and arranged such that the inner periphery thereof is arranged facing a central portion along the axis of the external surface of the main shaft 2 at a slight gap therefrom. An air supply channel 20, which supplies compressed air in spaces between the housing 12 and the periphery of the main shaft 2 via the bearing main unit 18, is provided inside of the housing 12 and extends to the external surfaces of the bearing main unit 18 of the radial static pressure gas bearings 14. Meanwhile, the axial static pressure gas bearings 16 are structured such that a bearing main unit 22 thereof made of a porous material is ring-shaped and has an oblong cross section, fixed to the base (right end in FIG. 1) of the housing 12, and is arranged such that an axial side (right side in FIG. 1) faces the circumference of the opposite side (left side) to the fixing side of the annular portion 6, which comprises the impeller 4, for the impeller main body 8. The air supply channel 20 extends to the external surface of the bearing main unit 22 of the axial static pressure gas bearings 16 so as to also supply compressed air to spaces from a side of the annular portion 6 of the impeller 4 via the periphery of the bearing main unit 22.

When rotatably supporting the main shaft 2 and the impeller 4 using the radial static pressure gas bearings 14 and the axial static pressure gas bearings 16, compressed air is continuously provided in the gaps between the bearing main bodies 18 and 22, the main shaft 2, and the impeller 4 (the annular portion 6) via the air supply channel 20, the radial static pressure gas bearings 14, the axial static pressure gas bearings 16, and the bearing main bodies 18 and 22. The compressed air supplied to the spaces is blown continuously on a side of the annular portion 6 and the external surface of the main shaft 2, forming a film of air in all of the spaces due to the compressed air. As a result, the main shaft 2 and the impeller 4 keep a noncontact state with the bearings 14 and 16 via the film, and are supported rotatably by the bearings 14 and 16.

Note that the compressed air continuously supplied to the spaces through the air supply channel 20 is successively exhausted to the exterior space via exhaust holes 24, which are provided within the bearing main body 18 of the radial static pressure gas bearings 14, an exhaust channel 26, which is provided within the housing 12, and spaces within the housing 12. In the case of mounting an air motor (spindle device with air turbine), which makes such a structure, on an electrostatic spray gun of an electric painting device, the impeller 4 and the main shaft 2 to which the impeller 4 is fixed should be aligned along the axis by other axial static pressure gas bearings (not illustrated in the drawing), which are additional ones to the axial static pressure gas bearings 16, rotatably supporting the opposite side (i.e., the fixing side for the impeller main body 8 (right side in FIG. 1)) to the supporting side of the annular portion 6, which is supported by the axial static pressure gas bearings 16.

Moreover, the impeller 4 is arranged in the housing 12 such that the inner periphery on the base side (right end side in FIG. 1) and the outer periphery of the impeller main body 8 may face each other all around. In other words, the base side inner periphery of the housing 12 is positioned radially outward from the impeller main unit 8.

Multiple (for example, six holes at equal intervals in the structure illustrated in FIG. 2) turbine air nozzle holes 28, which are formed at predetermined intervals along the circumference toward the periphery of the impeller main body 8, are formed on the base side of the housing 12, which is positioned radially outward from the impeller main body 8. These turbine air nozzle holes 28 are formed such that all centers thereof are positioned within a virtual plane orthogonal to a central axis of the housing 12, and tilt at the same angle with respect to the radial direction of the housing 12 (in other words, they forward-tilt in the normal rotative direction (right rotative direction C in FIG. 2) of the impeller 4.) Furthermore, these turbine air nozzle holes 28 continue to a turbine air supply channel 30, which has an opening 28*u* on an upstream end (compressed air (turbine air) supply source side) formed all around near the base side periphery of the housing 12, and the turbine air supply channel 30 continues to a turbine air supply opening 32, which opens to the base (right end in FIG. 1) of the housing 12 at one place along the circumference. Meanwhile, the respective turbine air nozzle holes 28 have downstream ends (turbine air spray inlets) 28*d* open to the base side inner periphery of the housing 12. In other words, the downstream ends (turbine air spray inlets) 28*d* of the respective turbine air nozzle holes 28 are formed closely facing the multiple turbine blades 10 formed on the external surface of the impeller main unit 8.

Furthermore, a brake air nozzle hole 34 is formed in the housing 12, opening to the periphery of the impeller main body 8 such that it does not overlap with the above multiple turbine air nozzle holes 28 on the base side. The brake air nozzle hole 34 is formed such that the center thereof is positioned within a virtual plane having the same central axis as the turbine air nozzle holes 28 (i.e., within a virtual plane orthogonal to the central axis of the housing 12 that is the same as those of the turbine air nozzle holes 28) and tilts at a predetermined angle (approximately the same angle as the turbine air nozzle holes 28) in the opposite direction than the turbine air nozzle holes 28 with respect to the radial direction of the housing 12 (in other words, forward-tilts in reverse rotative direction of the impeller 4 (left rotative direction A in FIG. 2)). Moreover, the brake air nozzle hole 34 has an upstream end (brake air supply source side) opening 34*u* continuing to a brake air supply opening 36, which opens to the base (right end in FIG. 1) of the housing 12, and a downstream end (brake air spray inlet) 34*d* opening on the base side inner periphery of the housing 12. In other words, the downstream end (brake air spray inlet) 34*d* of the brake air nozzle hole 34 is formed closely facing the multiple turbine blades 10 formed on the external surface of the impeller main body 8.

Note that a circular rotation detecting sensor 38 is arranged on the base side of the housing 12 such that the inner periphery of the bearing main unit 22 of the axial static pressure gas bearings 16 and the other axial side (left side in FIG. 1) of the impeller main body 8 may face each other with a predetermined distance therebetween. The rotation detecting sensor 38 includes a detector (right side portion in FIG. 1) capable of facing the other axial side of the impeller main body 8 and a to-be-detected unit (encoder) on the other side of the impeller main unit 8. This constitutes a sensor mechanism for detecting rotational state (rotation speed, rotative direction, and the like) of the impeller 4. With the sensor mechanism, the rotational state (rotation speed, rotative direction, and the like) of the impeller 4 is detected by detecting and measuring positional change of the to-be-detected unit (encoder) using the detector.

A magnet, for example is employed as the rotation detecting sensor 38 in the air motor illustrated in FIG. 1. This is because the axial bearing 16 is provided only on the output side of the rotary movement, as shown in FIG. 1, which may allow the main shaft 2, the impeller 4, and the impeller main body 8 to slip out to the opposite side to the output side (opposite direction than the output side of the rotary movement) of the rotary movement. Employment of the magnet for the rotation detecting sensor 38 thereby allows attraction to the main shaft 2 so as to reduce the chance of the main shaft 2, the impeller 4, and the impeller main body 8 from slipping out to the opposite side to the output side of the rotary movement. In this manner, as long as the rotation detecting sensor 38 can suppress the possibility mentioned above, function and arranging position may be appropriately selected according to purpose. For example, installation of the axial bearings 16 on either side of the impeller 4 allows a structure not employing a magnet as the rotation detecting sensor 38.

When coating using an electrostatic spray gun of an electric painting device on which the air motor (spindle device with air turbine) making such a structure is mounted, the air motor operates in the following manner.

As described above, the main shaft 2 and the impeller 4 are rotatably supported on the housing 12 by the radial static gas bearings 14 and the axial static gas bearings 16, respectively. In this state, compressed air (turbine air) is supplied to the multiple turbine air nozzle holes 28 via the turbine air supply opening 32 and the turbine air supply channel 30. The supplied compressed air (turbine air) is blown onto the multiple turbine blades 10 formed on the periphery of the impeller main unit 8 from the downstream ends (turbine air spray inlets) 28*d* of the respective turbine air nozzle holes 28. As a result, the turbine blades 10 are continuously depressed in their tilt direction, namely normal rotative direction (right rotative direction C in FIG. 2) of the impeller 4, rotating the impeller 4 and the main shaft 2 in the normal rotative direction at a predetermined rotation speed (e.g., several tens of thousands rpm).

A coating material is then supplied into a predetermined cup (not illustrated in the drawing) via a coating material supply-pipe (not illustrated in the drawing) inserted inside of the main axis 2 in this state. The cup is fixed to a portion of the front end (left end in FIG. 1) of the main shaft 2 that protrudes (is exposed) to the outside of the housing 12, and is negatively charged. As a result, the coating material supplied to the cup is made into ion microparticles within the cup that rotates at a high speed along with the main shaft 2.

The coating material made into ion microparticles is thrown toward a positively-charged surface to be coated utilizing electrostatic attraction and adhered on that surface. Note that the compressed air (turbine air) blown onto the respective turbine blades 10 is exhausted out into the outside space from an opening on the base side of a circular space 40 between the inner periphery on the base side of the housing 12 and the outer periphery of the impeller main body 8 via an exhaust channel (not illustrated in the drawing) connecting to the opening.

On the other hand, in the case of stopping the coating operation on the surface to be coated, supply of compressed air (turbine air) to the respective turbine air nozzle holes 28 and supply of the coating material to the cup are stopped, and compressed air (brake air) is supplied to the brake air nozzle hole 34 via the brake air supply opening 36. The supplied compressed air (brake air) is blown onto the multiple turbine blades 10 from the downstream end (turbine air spray inlet) 34*d* of the brake air nozzle hole 34. As a result, the turbine blades 10 are continuously depressed in the opposite direction of their tilt direction, namely reverse direction (left rotative direction A in FIG. 2) of the impeller 4, thereby imposing a negative load on the inertia rotation in the normal rotative direction of the impeller 4 and the main shaft 2 so as to halt early.

Then, once the rotation detecting sensor 38 has detected that the rotation speed of the impeller 4 and the main shaft 2 has slowed down and rotation thereof completely stops, supply of compressed air (brake air) to the brake air nozzle hole 34 is then stopped.

Note that even in this case, the compressed air (brake air) blown onto the respective turbine blades 10 is exhausted out to the outside space from the opening on the base side of the circular space 40.

However, driving force of the air motor is dependant on momentum of the jet flow from the nozzle that hits a turbine, namely momentum of the compressed air (turbine air) ejected from the downstream ends (turbine air spray inlets) 28*d* of the turbine air nozzle holes 28 to be blown onto the multiple turbine blades 10 that are formed on the periphery of the impeller 4 (more specifically, the impeller main body 8). The driving force (torque) of the impeller 4 sprayed with the compressed air (turbine air) at that time is calculated using the following Equation 1 (See Non-patent Document 1). Note that in Equation 1, T denotes torque of the turbine (the impeller 4), F denotes momentum (driving force) of jet flow (ejected compressed air from the turbine air nozzle holes 28) from the nozzle, R denotes radius of the turbine (the impeller 4 sprayed with the ejected compressed air) on which the jet flow impacts, m denotes mass (where mass flow rate×Δt) of the jet flow (ejected compressed air), V denotes flow velocity of the jet flow (the ejected compressed air), and Vt denotes circumferential velocity (where $V_t$ is 2πRN and N denotes motor rotation frequency) at the region (region of the impeller 4 on which the jet flow impacts) impacted by the jet flow.

[Equation 1]

$$T=F\cdot R=m(V-V_t)R \tag{1}$$

The flow velocity of the gas flowing into the nozzle (flow velocity of the compressed air (turbine air) immediately after being supplied to the turbine air nozzle holes 28 from the turbine air supply channel 30 via the upstream end openings 28*u* or inlet to the turbine air nozzle holes 28; hereafter it is referred to as inlet flow velocity) is not acoustic velocity even under choked conditions such that maximum velocity as j et flow is attained in the nozzle, and is calculated using the following Equation 2. Note that in Equation 2, $v_e$ denotes inlet flow velocity in the nozzle (the turbine air nozzle holes 28) in a choked state, $a_0$ denotes acoustic velocity, and k denotes specific heat ratio of compressed air (turbine air).

[Equation 2]

$$v_e = a_0\sqrt{\frac{2}{k+1}} \text{ (about 313 m/s)} \tag{2}$$

Moreover, mass (namely, maximum value of mass flow rate) of the jet flow (ejected compressed air) in the above choked state is calculated using the following Equation 3. Note that in Equation 3, $m_{max}$ denotes mass of the jet flow (ejected compressed air) in the above choked state, $\rho_0$ denotes density of the compressed air (turbine air) on the upstream side, and $A_e$ denotes inlet area of the nozzle (the turbine air nozzle holes 28).

[Equation 3]

$$m_{max} = \left(\frac{2}{k+1}\right)^{\frac{k+1}{2(k-1)}}\rho_0 a_0 A_e \tag{3}$$

where if specific heat ratio (k) is 1.40, isopiestic specific heat $C_p$ is 1007 (J/kg·K), and temperature of the compressed air (turbine air) on the upstream side is T (K), the acoustic velocity ($a_0$) is represented by the following Equation 4.

[Equation 4]

$$a_0=\sqrt{c_p(k-1)T} \tag{4}$$

Furthermore, the density ($\rho_0$) of the compressed air (turbine air) on the upstream side is calculated using the following Equation 5. Note that in Equation 5, $P_0$ denotes pressure of the compressed air (turbine air) on the upstream side.

[Equation 5]

$$\rho_0 = 1.293\frac{273.15}{T}\frac{p_0}{1.013\times 10^5} \tag{5}$$

In light of the above, in order to improve driving efficiency of the air motor, the inlet flow velocity ($v_e$) (approximately 313 m/s) of the compressed air (turbine air) in the nozzle (the turbine air nozzle holes 28) in a choked state should be raised to the acoustic velocity (340 m/s). For example, expanding the compressed air (turbine air) using pressure drop in the compressed air by fluid friction (inner periphery of the turbine air nozzle holes 28) of the nozzle makes it possible to increase the inlet flow velocity ($v_e$). However, even in this case, the maximum velocity is acoustic velocity (340 m/s).

Making the inlet flow velocity ($v_e$) be the acoustic velocity through flow velocity increase is achieved in the case where length of the nozzle is set to L or greater, which is represented in Equation 6 (see Non-patent Document 2) given below when $M_1$ is $v_e/a_0$. Note that in Equation 6, $r_h$ denotes hydraulic radius (inner radius in the case of round holes or circular tubes, cross-sectional area A in the case of square holes and square tubes, and is defined by 2×A/C in the case where circumference length is C), and $c_f$ denotes viscous friction factor of the wall (inner periphery of the turbine air nozzle holes 28) of the nozzle (holes and tubes). At that time, the viscous friction factor ($c_f$) is given as $0.0576\times Re^{-0.2}$ using the Reynolds number (Re=vD/ν) when v denotes flow velocity of compressed air, D denotes diameter (inner diameter) of the nozzle (holes and tubes), and ν denotes kinematic viscosity.

In this manner, Equation 6 holds true even when the cross-sectional shape of the nozzle (the turbine air nozzle holes 28) is other shapes than round, such as square.

[Equation 6]

$$L = \frac{r_h}{2c_f}\left(\frac{1-M_1^2}{kM_1^2} + \frac{k+1}{2k}\ln\left(\frac{(k+1)M_1^2}{2+(k-1)M_1^2}\right)\right) \tag{6}$$

PRIOR ART DOCUMENTS

Patent Documents

Patent Document 1: JP 2006-300024 A
Patent Document 2: JP 2009-243461 A

Non-Patent Documents

Non-patent Document 1: Yukio Tomita, 'Hydraulics', Jikkyo Shuppan Co., Ltd., 1982, p. 224
Non-patent Document 2: Yasuo Mori, Syoji Isshiki, HaruoKawada, 'Introduction to Thermodynamics', Yokendo, Co., Ltd., 1989, p. 214

SUMMARY OF INVENTION

Problem To Be Solved

As described above, in order to improve driving efficiency of the air motor, the inlet flow velocity ($v_e$) of the compressed air in the nozzle (holes and tubes) in a choked state should be raised to be close to the acoustic velocity (340 m/s). In other words, in designing the nozzle (the turbine air nozzle holes 28) of the air motor, it is considered effective to set the length of the nozzle to at least the value (namely L) calculated by Equation 6 in accordance with the inlet flow velocity ($v_e$) in the nozzle calculated from the maximum torque required by the air motor, diameter size (hydraulic radius) ($r_h$) of the nozzle, and supply source conditions for the compressed air (specifically, supply pressure ($p_0$) or supply flow rate).

However, no technology for optimum design of the nozzle based on the inlet flow velocity ($v_e$) in the nozzle, diameter size (hydraulic radius) ($r_h$) of the nozzle, and supply conditions for the compressed air (supply pressure ($p_0$) or supply flow rate) so as to improve driving efficiency of the air motor is not yet currently known.

The present invention has been devised so as to resolve such problems, and an object thereof is to provide an air motor improving drive efficiency by setting length of a nozzle based on compressed air inlet flow velocity in the nozzle (holes and tubes), which supplies compressed air to be blown onto turbine blades of an impeller, diameter size (hydraulic radius) of the nozzle, and supply conditions for the compressed air (supply pressure or supply flow rate).

Solution to the Problem

In order to achieve such an object, an air motor according to an embodiment of the present invention includes a housing, a main shaft inserted inside of the housing, an impeller fixed concentrically with the main shaft to an inserted portion of the main shaft inside of the housing and having multiple turbine blades formed on the outer periphery, bearings for rotatably supporting the main shaft and the impeller in the housing, and at least one nozzle having a tubular or hole-shaped channel for ejecting compressed air to the respective turbine blades for rotating the impeller along the circumference. With this air motor, when $M_1=v_e/a_0$ where $r_h$ denotes hydraulic radius of the channel of the nozzle, $c_f$ denotes viscous friction factor of a wall of the channel, k denotes specific heat ratio of compressed air, $v_e$ denotes flow velocity of the compressed air in an entrance of the channel, and $a_0$ denotes acoustic velocity, L is calculated using

[Equation 7]

$$L = \frac{r_h}{2c_f}\left(\frac{1-M_1^2}{kM_1^2} + \frac{k+1}{2k}\ln\left(\frac{(k+1)M_1^2}{2+(k-1)M_1^2}\right)\right) \quad (6)$$

and the channel of the nozzle has a length set to a dimension of the calculated value of L or greater.

Note that while the channel of the nozzle should be set to the dimension of the calculated value of L or greater, it is preferable to set it to a predetermined dimension of five times the calculated value of L or greater at that time.

Moreover, the bearings are preferably static pressure gas bearings.

Furthermore, of the bearings, at least bearings on one end side are preferably structured as ceramic roller bearings.

Yet further, the roller bearings preferably include a raceway ring on one side mounted on the housing, and a raceway ring on the other side mounted on a spindle facing the raceway ring on the one side, and a plurality of rolling elements incorporated between these raceway ring, where either the bearing rings or the rolling elements or all of them are made of ceramics.

Yet even further, it is preferable that either the bearing rings or the rolling elements or all of them are made of non-conducting ceramics.

Yet even further, it is preferable that the bearing rings and the rolling elements are made of conducting ceramics.

Yet even further, an electric painting device of the present invention includes the air motor of any of the above configurations.

Advantageous Effect of the Invention

According to the present invention, an air motor improving drive efficiency by setting length (nozzle length) of a nozzle based on compressed air inlet flow velocity in the nozzle, which supplies compressed air to be blown onto turbine blades of an impeller, diameter size (hydraulic radius) of the nozzle, and supply conditions for the compressed air (supply pressure or supply flow rate), and an electric painting device may be implemented.

BRIEF DESCRIPTION OF THE DRAWINGS

FIG. 4 is a diagram showing supply pressure of compressed air to nozzle length in the case where compressed air is made to flow through a nozzle with a diameter (inner diameter) of 1.1 mm at a rate of 50 NL/min, and supply pressure ratio to a reference supply pressure;

FIG. 5 is a diagram showing supply pressure of compressed air to nozzle length in the case where compressed air is made to flow through a nozzle with a diameter (inner diameter) of 1.8 mm at a rate of 50 NL/min, and supply pressure ratio to a reference supply pressure;

FIG. 6 is a diagram showing supply pressure of compressed air to nozzle length in the case where compressed air is made to flow through a nozzle with a diameter (inner diameter) of 1.8 mm at a rate of 150 NL/min, and supply pressure ratio to a reference supply pressure;

FIG. 7 is a diagram showing supply pressure of compressed air to nozzle length in the case where compressed air is made to flow through a nozzle with a diameter (inner diameter) of 2.5 mm at a rate of 150 NL/min, and supply pressure ratio to a reference supply pressure;

FIG. 8 is a diagram showing supply pressure of compressed air to nozzle length in the case where compressed air is made to flow through a nozzle with a diameter (inner diameter) of 2.5 mm at a rate of 300 NL/min, and supply pressure ratio to a reference supply pressure;

DESCRIPTION OF EMBODIMENTS

Figure 1:
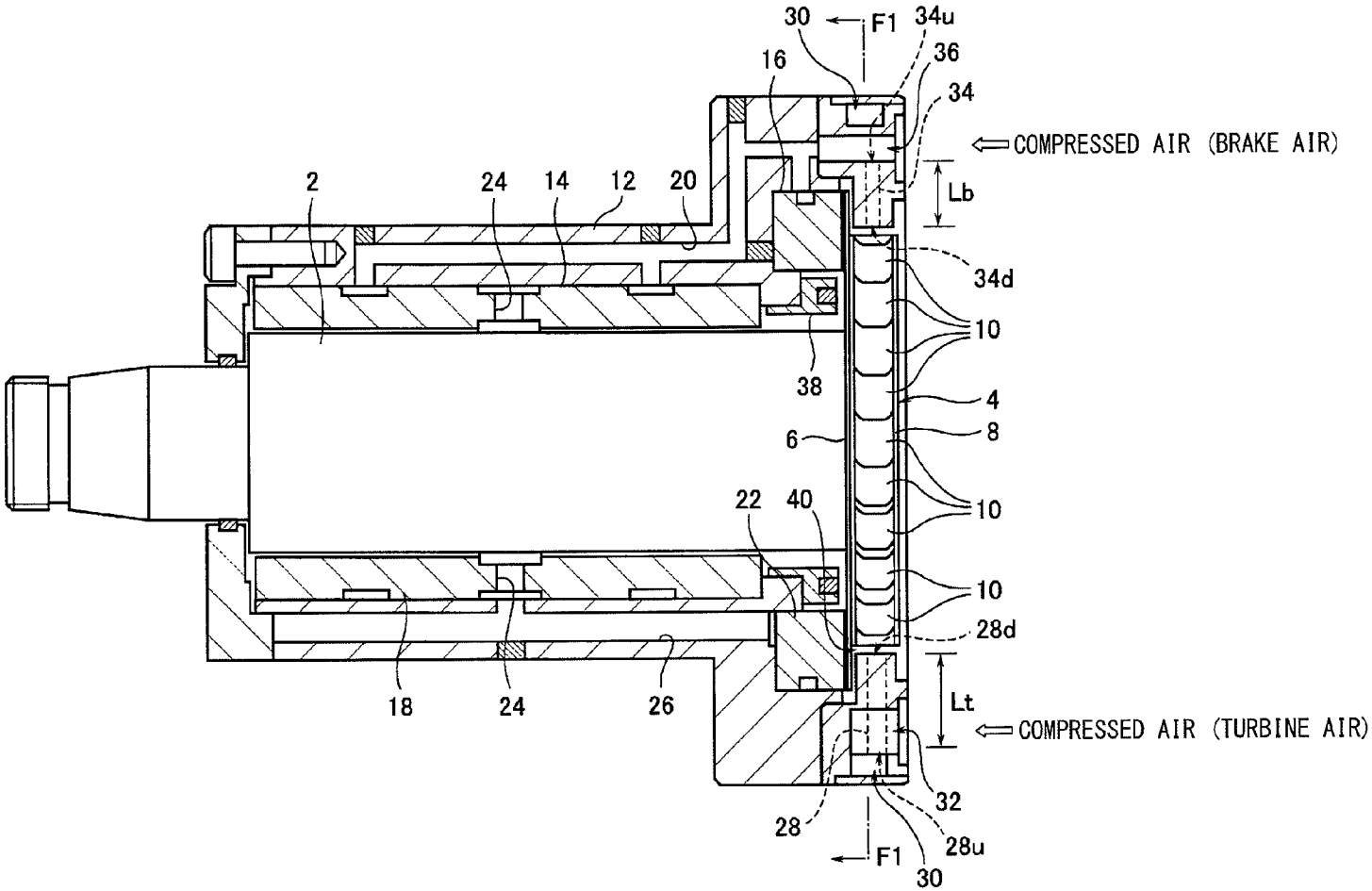
FIG. 1 is a cross-sectional view illustrative of a structure of an air motor according to an embodiment of the present invention.

Embodiments including an air motor of the present invention will now be described with reference to the attached drawings. Note that while the air motor according to this embodiment may be assumed to be mounted on a spindle device that is used in an electric painting process, or on a drive member of a main spindle system for a machine tool, that uses small tools in diameter needed for high velocity revolution, for example, the mounting instrument is not limited thereto.

Moreover, the air motor according to this embodiment limits length of the nozzle that constitutes the air motor to a dimension within a predetermined range, and there is no problem for the basic configuration of the air motor other than the nozzle to be that of a well-known air motor. Therefore, the configuration (FIGS. 1 and 2) of the air motor (spindle device with air turbine) mounted on an electrostatic spray gun of an electric painting device as described above is assumed as a motor configuration example, where this embodiment is described on the premise of this motor configuration.

The air motor according to this embodiment includes the housing 12, a main shaft 2, which is inserted inside of the housing 12, the impeller 4, which is fixed to a portion of the main shaft 2 inserted inside of the housing 12 concentrically with the main axis 2 and has the multiple turbine blades 10 formed on the outer periphery, static pressure gas bearings (the radial static pressure gas bearings 14 and the axial static pressure gas bearings 16) for rotatably supporting the main axis 2 and the impeller 4 in the housing 12, and at least one of nozzles 28 and 34 having tubular or hole-shaped channels for ejecting compressed air to the respective turbine blades 10 for rotating the impeller 4 along the circumference.

As described above, while the air motor illustrated in FIGS. 1 and 2 is assumed as an example configuration in this embodiment, the housing 12, the main axis 2, the impeller 4, and the static pressure gas bearings (the radial static pressure gas bearings 14 and the axial static pressure gas bearings 16) are not particularly limited to the illustrated configuration of the drawings, and may be modified appropriately in accordance with intended purpose and use conditions of the air motor. For example, configuration of the housing 12 and the main shaft 2, size and number of the impeller 4, configuration and number of the turbine blades 10 formed on the impeller main body 8 of the impeller 4, arranging position and number of the static pressure gas bearings 14 and the axial static pressure gas bearings 16 need to be respectively set arbitrarily in accordance with intended purpose and use conditions of the air motor.

Figures 2, 3:
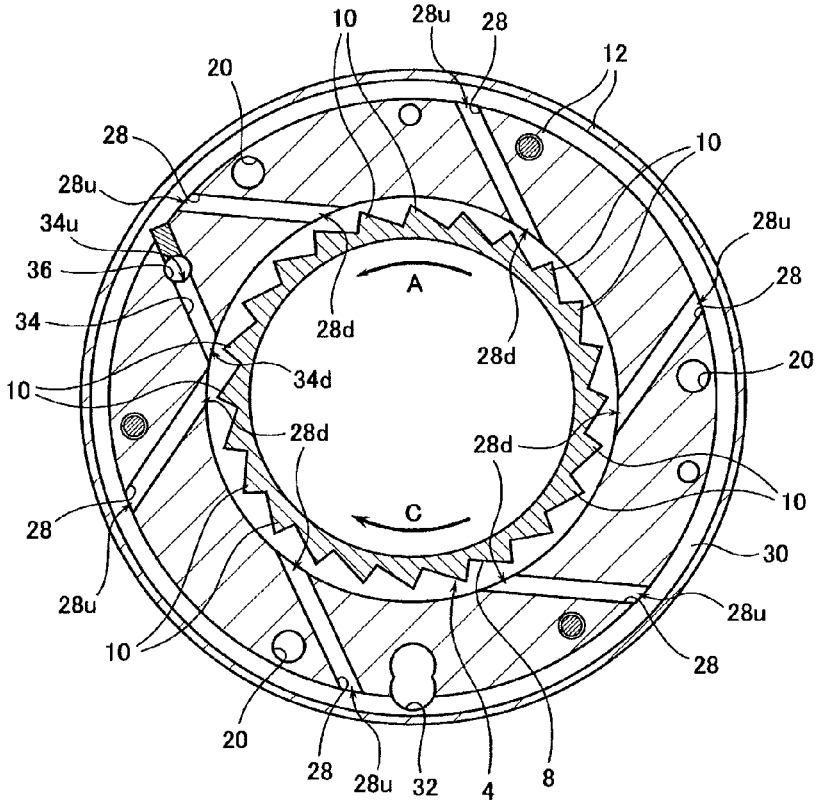
FIG. 2 is a cross-sectional view of the air motor shown in FIG. 1 cut along line F1-F1.
FIG. 3 is a diagram showing supply pressure of compressed air to nozzle length in the case where compressed air is made to flow through a nozzle with a diameter (inner diameter) of 1.1 mm at a rate of 20 NL/min, and supply pressure ratio to a reference supply pressure.

In the configuration given in FIGS. 1 and 2, the turbine air nozzle holes 28 are formed such that all centers thereof are positioned within the same virtual plane (hereafter referred to as turbine air nozzle hole formation plane) that is orthogonal to the central axis of the housing 12, and tilt (forward-tilt in the normal rotative direction (right rotative direction C in FIG. 2) of the impeller 4) at the same angle with respect to the radial direction of the housing 12. In this case, the turbine air nozzle holes 28 are formed on the base side of the housing 12 as holes opening to the outer periphery of the impeller 4 (impeller main body 8), and include hole-shaped channels for spraying compressed air (turbine air) to the respective turbine blades 10 so as for the impeller 4 to rotate along the circumference (normal rotative direction C).

Moreover, the brake air nozzle hole 34 is formed such that the center thereof is positioned within the same plane as the turbine air nozzle hole formation plane, and tilt (forward-tilt in reverse rotative direction (left rotative direction A in FIG. 2) of the impeller 4) at a predetermined angle (for example, approximately the same angle as the turbine air nozzle holes 28) in the opposite direction than the turbine air nozzle holes 28 with respect to the radial direction of the housing 12. In this case, the brake air nozzle hole 34 is formed on the base side of the housing 12 as holes opening to the outer periphery of the impeller 4 (impeller main body 8) so as not to overlap with the turbine air nozzle holes 28, and includes a hole-shaped channel for spraying compressed air (brake air) to the respective turbine blades 10 so as for the impeller 4 to rotate along the circumference (reverse rotative direction A).

In other words, the turbine air nozzle holes 28 and the brake air nozzle hole 34 are respectively configured as a nozzle of the air motor.

Note that arranging position, number, and cross-sectional form of the turbine air nozzle holes 28 and the brake air nozzle hole 34 may be arbitrarily set. For example, while FIGS. 1 and 2 illustrate a configuration of an air motor in which six of the turbine air nozzle holes 28 are formed such that centers thereof are positioned and open in the same turbine air nozzle formation plane at equal intervals on the base side of the housing 12 toward the outer periphery of the impeller 4 (impeller main body 8), a configuration in which the same or a different number of turbine air nozzle holes 28 are formed such that the centers thereof are positioned in multiple turbine air nozzle hole formation planes is possible. Moreover, while FIGS. 1 and 2 illustrate a configuration of an air motor in which only a single brake air nozzle hole 34 is formed, a configuration in which multiple brake air nozzle holes 34 are formed with the same aspects (except for tilt direction) as any of the above turbine air nozzle holes 28 is also possible. Furthermore, while FIGS. 1 and 2 illustrate a configuration of an air motor in which the turbine air nozzle holes 28 and the brake air nozzle hole 34 are formed as round holes with circular cross-sectional forms, a configuration in which the turbine air nozzle holes 28 and the brake air nozzle hole 34 are formed as square holes with square (polygon such as a quadrangle) cross-sectional forms is also possible.

Yet even further, while FIGS. 1 and 2 illustrate a configuration of a nozzle (the turbine air nozzle holes 28 and the brake air nozzle hole 34) having hole-shaped channels for ejecting compressed air (turbine air or brake air) to the respective turbine blades 10 so as for the impeller 4 to rotate along the circumference (either normal rotative direction C or reverse rotative direction A), the nozzle may have tubular (for example, a round or square (polygon such as a quadrangle) cross-sectional form) channels.

Length of the channels of the nozzle (distance (distances Lt and Lb in FIG. 1) from the upstream end openings 28*u* and 34*u* until the downstream end openings 28*d* and 34*d*) is set to a dimension of at least L, which is calculated using the following Equation 6. Note that in Equation 6, $r_h$, denotes hydraulic radius ($2\times\pi r^2/2\pi r=r$ (inner radius) when inner radius is r) of the nozzle (the turbine air nozzle holes 28 and the brake air nozzle hole 34), and $c_f$ denotes viscous friction factor of the wall (inner periphery of the turbine air nozzle holes 28 and the brake air nozzle hole 34) of the nozzle. At that time, the viscous friction factor ($c_f$) is given as $0.0576\times Re-0.2$ using the Reynolds number ($Re=vD/\nu$) when v denotes flow velocity of compressed air (turbine air and brake air), D denotes diameter (inner diameter) of the nozzle (the turbine air nozzle holes 28 and the brake air nozzle hole 34), and ν denotes kinematic viscosity.

Equation 8

$$L = \frac{r_h}{2c_f}\left(\frac{1-M_1^2}{kM_1^2} + \frac{k+1}{2k}\ln\left(\frac{(k+1)M_1^2}{2+(k-1)M_1^2}\right)\right) \tag{6}$$

Nozzle lengths (nozzle length Lt of the turbine air nozzle holes 28 and nozzle length Lb of the brake air nozzle hole 34)

of the nozzle are not particularly limited and may be arbitrarily set in accordance with intended purpose and use conditions of the air motor as long as it is set to at least the calculated value L using Equation 6. As an example, this embodiment assumes a case where the nozzle lengths Lt and Lb of the nozzle (28 and 34) are set to predetermined dimension of 5 times or more (5L≤Lt, 5L≤Lb) than the calculated value L.

The inlet flow velocity ($v_e$) of the compressed air (turbine air and brake air) in the nozzle (the turbine air nozzle holes 28 and the brake air nozzle hole 34) in a choked state may be raised to be close to the acoustic velocity (340 m/s) by setting the nozzle lengths Lt and Lb of the nozzle (28 and 34) to such dimension settings (5L≤Lt, 5L≤Lb). In other words, optimum design of the nozzle (28 and 34) is possible based on the inlet flow velocity ($v_e$) in the nozzle (28 and 34) calculated from maximum torque required by the air motor, diameter size (hydraulic radius) ($r_h$) of the nozzle (28 and 34), and supply source conditions for the compressed air (specifically, supply pressure ($p_0$) or supply flow rate).

In this manner, by setting of the nozzle lengths of the nozzle (28 and 34) based on inlet flow velocity of compressed air ($v_e$) (turbine air and brake air) in the nozzle (the turbine air nozzle holes 28 and the brake air nozzle hole 34), which supplies the compressed air to be blown onto the turbine blades 10 of the impeller 4, diameter size (hydraulic radius) ($r_h$) of the nozzle (28 and 34), and supply conditions for the compressed air (supply pressure ($p_0$) or supply flow rate), improvement in drive efficiency effectively at the times of rotating and stopping is possible.

Note that in this embodiment, while setting the nozzle lengths Lt and Lb of the nozzle, which is constituted by the turbine air nozzle holes 28 and the brake air nozzle hole 34, to dimensions of at least the calculated value L, for example, predetermined dimensions of five times or more (5L≤Lt, 5L≤Lb) than the calculated value L is assumed, if rotation efficiency of the air motor is specialized, there is no particular problem of setting only the nozzle length Lt of the turbine air nozzle holes 28 to a predetermined dimension of five times or more (5L≤Lt) than the calculated value L, and the nozzle length Lb of the brake air nozzle hole 34 does not necessarily need to be set to a predetermined dimension of five times or more (5L≤Lb) than the calculated value L.

Specific examples of nozzle lengths that should be set when a constant flow of compressed air (turbine air and brake air) is made to flow through nozzles (the turbine air nozzle holes 28 and the brake air nozzle hole 34) 1.1 mm, 1.8 mm, and 2.5 mm in diameter (inner diameter) are given below (FIG. 3 to FIG. 8).

As shown in FIG. 3, the calculated value L from Equation 6 in the case where compressed air is made to flow through the nozzle 1.1 mm in diameter (inner diameter) at a rate of 20 NL/min is 0.34 mm (L=0.34). Moreover, when the nozzle lengths Lt and Lb are set to predetermined dimension within a range of 1.0 to 40.0 times the calculated value L, a supply pressure needed to secure a compressed air flow rate of 20 NL/min is within a range of 0.18 MPa to 0.24 MPa. If 0.18 MPa or the minimum supply pressure of this case is the reference supply pressure (typical supply pressure when the nozzle lengths Lt and Lb are 5.60 mm (16.5L)), supply pressure rate (supply pressure/reference supply pressure, hereafter referred to as supply pressure ratio) when setting dimensions (L≤Lt, Lb≤40L) of the respective nozzle lengths Lt and Lb for the standard supply pressure is smaller than 1.10 except for the case where the nozzle lengths Lt and Lb are L mm (L=0.34) and 4.4L mm (L=1.50), respectively, thereby keeping increasing rate of the counter-reference supply pressure under 10%.

As shown in FIG. 4, the calculated value L from Equation 6 in the case where compressed air is made to flow through the nozzle 1.1 mm in diameter (inner diameter) at a rate of 50 NL/min is 0.40 mm (L=0.40). Moreover, when the nozzle lengths Lt and Lb are set to predetermined dimension within a range of 1.0 to 40.0 times the calculated value L, a supply pressure needed to secure a compressed air flow rate of 50 NL/min is within a range of 0.44 MPa to 0.61 MPa. If 0.44 MPa or the minimum supply pressure of this case is the reference supply pressure (typical supply pressure when the nozzle lengths Lt and Lb are 6.40 mm (16.0L)), supply pressure rate is smaller than 1.10 except for the case where the nozzle lengths Lt and Lb are L ram (L=0.40) and 4.5L mm (L=1.80), respectively, thereby keeping increasing rate of the counter-reference supply pressure under 10%.

As shown in FIG. 5, the calculated value L from Equation 6 in the case where compressed air is made to flow through the nozzle 1.8 mm in diameter (inner diameter) at a rate of 50 NL/min is 0.59 mm (L=0.59). Moreover, when the nozzle lengths Lt and Lb are set to predetermined dimension within a range of 1.0 to 40.0 times the calculated value L, a supply pressure needed to secure a compressed air flow rate of 50 NL/min is within a range of 0.23 MPa to 0.16 MPa. If 0.16 MPa or the minimum supply pressure of this case is the reference supply pressure (typical supply pressure when the nozzle lengths Lt and Lb are 10.10 mm (17.1L)), supply pressure rate is smaller than 1.10 except for the case where the nozzle lengths Lt and Lb are L ram (L=0.59) and 4.4L mm (L=2.60), respectively, thereby keeping increasing rate of the counter-reference supply pressure under 10%.

As shown in FIG. 6, the calculated value L from Equation 6 in the case where compressed air is made to flow through the nozzle 1.8 mm in diameter (inner diameter) at a rate of 150 NL/min is 0.74 mm (L=0.74). Moreover, when the nozzle lengths Lt and Lb are set to predetermined dimension within a range of 1.0 to 40.0 times the calculated value L, a supply pressure needed to secure a compressed air flow rate of 150 NL/min is within a range of 0.68 MPa to 0.49 MPa. If 0.49 MPa or the minimum supply pressure of this case is the reference supply pressure (typical supply pressure when the nozzle lengths Lt and Lb are 12.60 mm (17.0L)), supply pressure rate is smaller than 1.10 except for the case where the nozzle lengths Lt and Lb are L mm (L=0.74) and 4.5L mm (L=3.30), respectively, thereby keeping increasing rate of the counter-reference supply pressure under 10%.

As shown in FIG. 7, the calculated value L from Equation 6 in the case where compressed air is made to flow through the nozzle 2.5 mm in diameter (inner diameter) at a rate of 150 NL/min is 1.00 mm (L=1.00). Moreover, when the nozzle lengths Lt and Lb are set to predetermined dimension within a range of 1.0 to 40.0 times the calculated value L, a supply pressure needed to secure a compressed air flow rate of 150 NL/min is within a range of 0.35 MPa to 0.26 MPa. If 0.26 MPa or the minimum supply pressure of this case is the reference supply pressure (typical supply pressure when the nozzle lengths Lt and Lb are 16.20 mm (16.2.1L)), supply pressure rate is smaller than 1.10 except for the case where the nozzle lengths Lt and Lb are L mm (L=1.00) and 4.4L mm (L=4.40), respectively, thereby keeping increasing rate of the counter-reference supply pressure under 10%.

As shown in FIG. 8, the calculated value L from Equation 6 in the case where compressed air is made to flow through the nozzle 2.5 mm in diameter (inner diameter) at a rate of 300 NL/min is 1.10 mm (L=1.10). Moreover, when the nozzle lengths Lt and Lb are set to predetermined dimension within a range of 1.0 to 40.0 times the calculated value L, a supply pressure needed to secure a compressed air flow rate of 300 NL/min is within a range of 0.51 MPa to 0.71 MPa. If 0.51 MPa or the minimum supply pressure of this case is the reference supply pressure (typical supply pressure when the nozzle lengths Lt and Lb are 18.70 mm (17.0L)), supply pressure rate is smaller than 1.10 except for the case where the nozzle lengths Lt and Lb are L mm (L=1.10) and 4.5L mm (L=4.90), respectively, thereby keeping increasing rate of the counter-reference supply pressure under 10%.

Considering the above, the nozzle lengths (nozzle length Lt of the turbine air nozzle holes 28 and nozzle length LB of the brake air nozzle hole 34) of the nozzle are preferably set to five times or more (5L≤Lt, 5L≤Lb) than the calculated value L using Equation 6. In other words, such setting allows raising of the inlet flow velocity ($v_e$) of the compressed air (turbine air and brake air) in the nozzle (the turbine air nozzle holes 28 and the brake air nozzle hole 34) in a choked state to be close to the acoustic velocity (340 m/s) without particularly increasing the compressed air supply pressure.

Note that if dimension of the nozzle lengths Lb and Lt are increased in the case of setting the nozzle lengths Lb and Lt of the nozzle (the turbine air nozzle holes 28 and the brake air nozzle hole 34) based on the inlet flow velocity ($v_e$) in the nozzle (28 and 34) calculated from maximum torque required by the air motor, diameter size (hydraulic radius) ($r_h$) of the nozzle (28 and 34), and supply source conditions for the compressed air (turbine air and brake air) (specifically, supply pressure ($p_0$) or supply flow rate), pressure drop in the compressed air (turbine air and brake air) also increases as a result. Therefore, the compressed air supply pressure also needs to be increased, so as to insure a predetermined flow rate.

Meanwhile, as illustrated in the respective concrete examples (FIG. 3 to FIG. 8) described above, if the nozzle lengths Lb and Lt are set to approximately 16 to 17 times the calculated value L using Equation 6, the compressed air supply pressure may be kept at approximately the minimum compressed air supply pressure (the reference supply pressure of the respective concrete examples given above), thereby not needing to excessively raise the supply pressure.

As a result, the nozzle lengths Lb and Lt are preferably set to predetermined dimensions (5L≤Lt, 5L≤Lb) with an upper limit of approximately 16 to 17 times the calculated value L using Equation 6.

Figure 9:
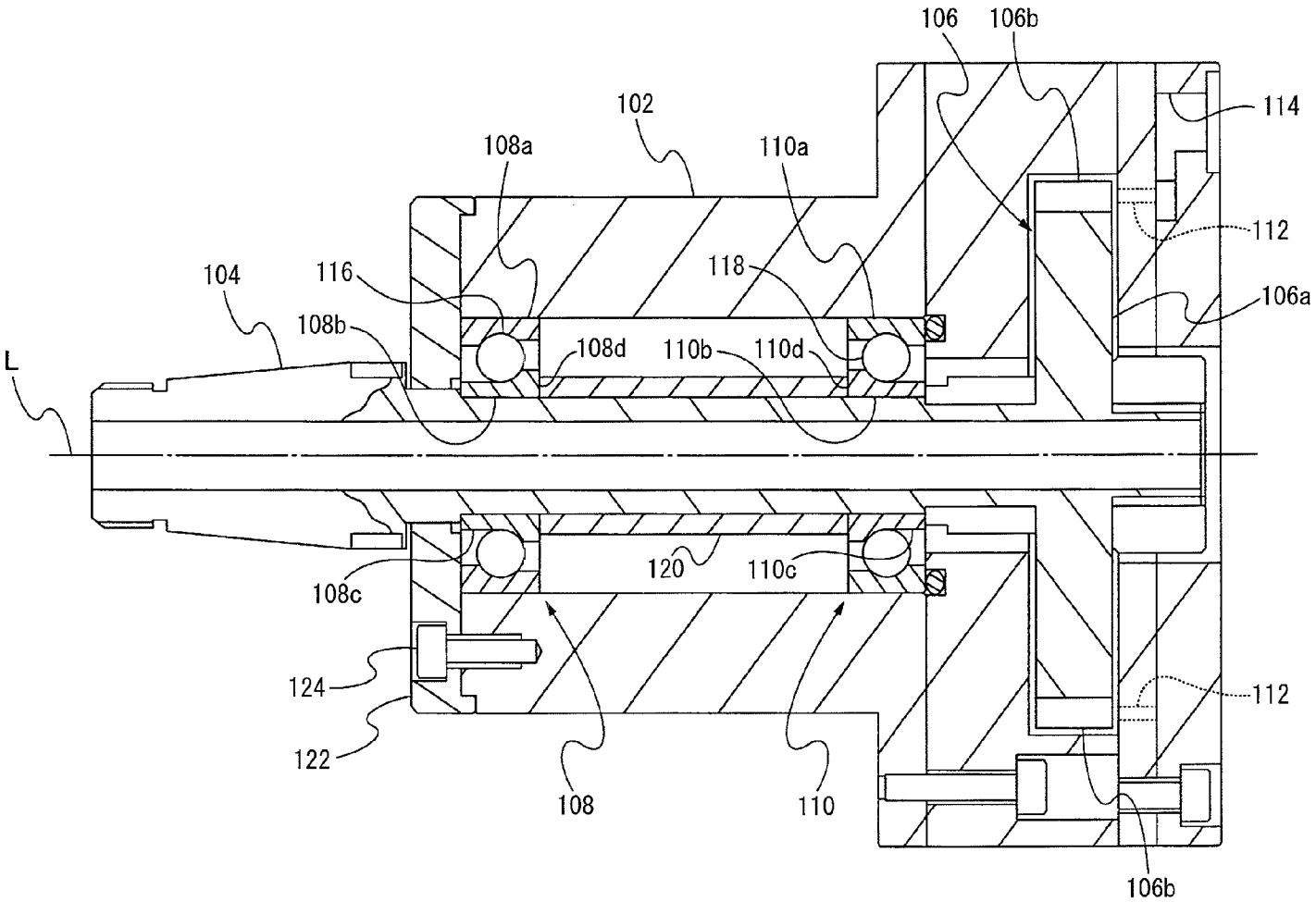
FIG. 9 is a cross-sectional view schematically illustrating an entire structure of a spindle device using an air motor according to another embodiment.

An embodiment of the present invention has been described; however, the present invention is not limited thereto, and various modifications and improvements may be made. For example, ball bearings may be used instead of the static pressure gas bearings for an air motor of another embodiment in accordance with intended purpose and use conditions. An example spindle device applying the air motor of this embodiment using ball bearings is described next. As shown in FIG. 9, the spindle device applying the air motor according to this embodiment includes a main shaft 104, which is arranged rotatably in a housing 102, for example, a turbine drive member 106, which is provided on the main shaft 104, and multiple bearings 108 and 110, which rotatably support the main shaft 104 in the housing 102. The spindle device transforms kinetic energy of a fluid such as compressed air, for example, into rotary movement by the turbine drive member 106 so as to make the main shaft 104 rotate at a desired speed.

With such a spindle device, the main shaft 104 is contained in the housing 102, its front end side extends beyond the housing 102 along a rotational axis L of the main shaft 104, and its base side establishes the turbine drive member 106. The turbine drive member 106 includes a disc-shaped turbine impeller 106*a*, which is formed extending orthogonal to the rotational axis L of the main shaft 104 and concentrically with the rotational axis L, and multiple blades 106*b*, which are formed along the circumference of the turbine impeller 106*a*.

Moreover, a turbine air current exhaust nozzle 112, which opens to the multiple blades 106*b* of the turbine drive member 106, is formed in the housing 102, and a compressed air supply source (not illustrated in the drawing) is connected to the turbine air current exhaust nozzle 112 via turbine air supply channel 114 that is formed in the housing 102.

In this case, if the compressed air supplied from the compressed air supply source is blown onto the respective blades 106*b* from the turbine air current exhaust nozzle 112 via the air supply channel 114, the air current behaves as pressure pushing the respective blades 106*b* circumferentially, and the pressure at this time becomes rotary movement via the turbine impeller 106*a* and is transmitted to the main shaft 104. This allows the main shaft 104 to turn at a desired velocity revolving around its rotational axis L.

Furthermore, the main shaft 104 is rotatably supported on the front end side by the multiple bearings 108 and 110 provided between the main shaft 104 and the housing 102. The drawing, as an example, illustrates a structure of two bearings, the bearing 108 on one end (rotary movement output side) in a region between the housing 102 and the main shaft 104, and the bearing 110 on the other end (rotary movement input side) supporting the main shaft 104.

The multiple bearings 108 and 110 are respectively configured as roller bearings including raceway rings 108*a* and 110*a* (outer rings) on one side mounted onto the housing 102, and raceway rings 108*b* and 110*b* (inner rings) on the other side mounted onto the main shaft 104 facing the outer rings 108*a* and 110*a*, and multiple rolling elements 116 and 118 incorporated between the outer and inner rings, respectively. In this case, balls and rollers may be applied as the rolling elements 116 and 118; however, balls 116 and 118 are assumed as an example here.

While as an example of the bearings 108 and 110 in the drawing, the roller bearings 108 and 110, which are applied counter-bored inner rings 108*b* and 110*b* with raceway groove shoulders 108*c* and 110 on one side completely or partially eliminated, are illustrated, they are not limited thereto and may be bearings having the outer and the inner rings counter-bored on one side, or bearings (e.g., deep groove ball bearings) having raceway groove shoulders on outer and the inner rings, for example. In any case, two types of the ball bearings 108 and 110 with the multiple rolling elements (balls) 116 and 118 integrated between the outer and the inner rings are assumed hereafter as the multiple bearings 108 and 110.

Note that these ball bearings 108 and 110 have the counter-bored inner rings 108*b* and 110*b* facing each other via a spacer 120 therebetween, respectively, where the ball bearings 108 are on one end and the ball bearings 110 are on the other end. Then in that state, if a cover member 122 is fastened to the housing 102 from the front end side of the main shaft 104 using, for example, a screw 124 or the like, the force acted on the ball bearings 108 (specifically, the outer rings 108*a*) on one end side at that time is transmitted to the ball bearings 110 (specifically, the inner rings 110*b*) on the other end side from the rolling member (balls) 118 and the inner ring 108*b* of the ball bearings 108 via the spacer 120, thereby pressing the rolling members (balls) 118 and the outer rings 110*a* of the ball bearings 110.

At this time, a predetermined preload is applied to the respective ball bearings 108 and 110, and are thus maintaining a state capable of receiving a radial load acting on the main shaft 104 and a bidirectional axial load. As a result, the main shaft 104 is supported radially and axially by the ball bearings 108 and 110, and may thus rotate around the constant rotational axis L.

Moreover, in this embodiment, the ball bearings 108 and 110 on the one end side and the other end side of the aforementioned spindle device are configured as ceramic roller bearings. A specification of ceramic ball bearings 108 and 110 may have any or all of the outer rings 108*a* and 110*a*, the inner rings 108*b* and 110*b*, and the rolling members (balls) 116 and 118 made of ceramics. In this case, discussion of the case where insulation between the housing 102 and the main shaft 104 is required and the case where conduction therebetween is required is necessary.

Configuration Example 1

Case Where Insulation Between Housing and Spindle is Required

In the case where insulation between the housing 102 and the main shaft 104 is required, any or all of the outer rings 108*a* and 110*a*, the inner rings 108*b* and 110*b*, and the rolling members (balls) 116 and 118 should be made of non-conducting (insulating) ceramics. The non-conducting (insulating) ceramics here may employ an oxide such as alumina, zirconia, or the like, or an insulating material of a high electric resistivity such as nitrogen silicon.

In this case, when the respective rolling members (balls) 116 and 118 are formed of such non-conducting (insulating) ceramics, the material of the outer rings 108*a* and 110*a* and the inner rings 108*b* and 110*b* is not particularly limited, and high-carbon chrome bearing steel or special steel (stainless steel), for example, may be applied.

Note that when the outer rings 108*a* and 110*a* are formed of such non-conducting (insulating) ceramics, the inner rings 108*b* and 110*b* and the rolling members (balls) 116 and 118 should be formed of high-carbon chrome bearing steel or special steel (stainless steel), for example. On the other hand, when the inner rings 108*b* and 110*b* are formed of such non-conducting (insulating) ceramics, the outer rings 108*a* and 110*a* and the rolling members (balls) 116 and 118 should be formed of high-carbon chrome bearing steel or special steel (stainless steel), for example.

Moreover, use of grease for high speed bearings, for example, is preferably used as a lubricant for sealing the ball bearings 108 and 110. Note that the grease for high speed bearings may have ester oil, for example, added thereto as a base oil.

Configuration Example 2

Case where Conduction Between Housing and Spindle is Required

In the case where conduction between the housing 102 and the main shaft 104 is required, all of the outer rings 108*a* and 110*a*, the inner rings 108*b* and 110*b*, and the rolling members (balls) 116 and 118 should be made of conductive ceramics. The conductive ceramics here may employ a ceramic material of a low electric resistivity dispersed finely with conductive ceramic particles in an oxide, such as aluminum oxide (alumina) or zirconium oxide (zirconia).

In this case, use of conductive grease, for example, is preferably used as a lubricant for sealing the ball bearings 108 and 110. Moreover, the conductive grease may have carbon black, a metal powder, a metal oxide, or the like, added thereto as filler. Note that conduction indicates a state where electric current flows, namely a state capable of power distribution.

According to this embodiment, the main shaft 104 may be supported sturdily in the housing 102 since the aforementioned ceramic ball bearings 108 and 110 have high bearing rigidity themselves. Therefore, the rotational axis L of the main shaft 104 may be kept constant without receiving any influence from a turning load of the turbine drive member 106 while the spindle device is operating, and the main shaft 104 may be rotated around the constant rotational axis L. As a result, for example, the main shaft 104 is never displaced so as to touch the housing 102 while the spindle device is operating.

In this case, since the rotational state (rotation speed) of the main shaft 104 may be kept constant, the rotation speed of the main shaft 104 may be stabilized at a constant desired speed. This allows uniform coating of an object to be coated without any unevenness on that object when the spindle device is used as an electric painting device, for example.

Moreover, while the spindle device needs to be enlarged since rigidity and load carrying capacity are determined by bearing size of the air bearings described above, use of the ceramic ball bearings 108 and 110 have high bearing rigidity themselves instead of air bearings allows a compact spindle device.

This allows significant reduction in cost for operating the spindle device than when the air bearings are applied. Furthermore, compared to when the air bearings are applied, the number of components of the entire spindle device may be considerably reduced since the number of the ball bearings 108 and 110 can be decreased, and cost for manufacturing the spindle device may be significantly reduced as a result.

Yet further, since the ceramic ball bearings 108 and 110 may have greater rotating performance than the air bearings, demand for high-speed rotation (for example, high-speed rotation of 60,000 revolutions per minute (rpm)) required by the spindle device may be met.

Note that the present invention is not limited to the above embodiments, and the technical ideas according to the following modifications are also contained within the technical scope of the present invention.

Figure 11:
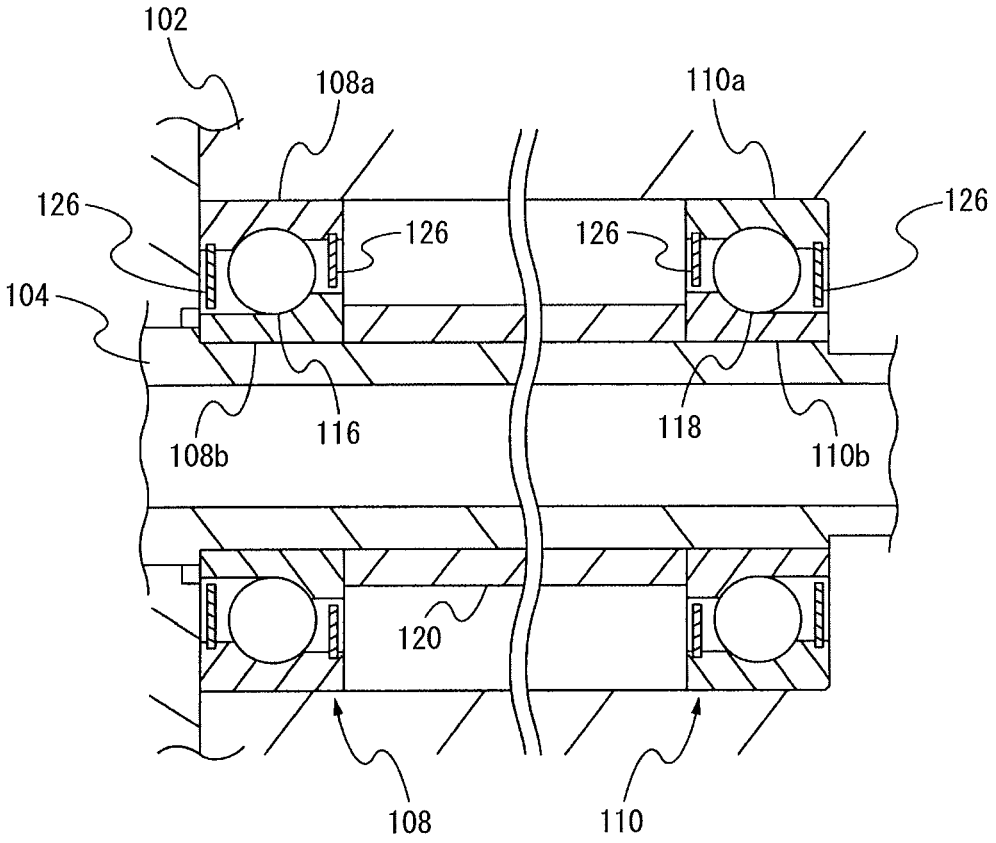
FIG. 11 is a cross-sectional view illustrating an enlarged structure around a ceramic ball bearing of a spindle device using an air motor according to another embodiment.

For example, as illustrated in FIG. 11, the respective ball bearings 108 and 110 may be given a sealed structure in Configuration Examples 1 and 2 described above. In the drawing, as an example sealed structure, sealing plates 126, which seal divided internal spaces of the bearings between the outer rings 108*a* and 110*a* and the inner rings 108*b* and 110*b* from outside of the bearings, are provided to each of the ball bearings 108 and 110.

A ring-shaped shield made by pressing a metal plate, for example, or a seal made of rubber containing a core bar may be applied as the sealing plates 126 here. Note that while a structure applying the sealing plates 126, which have base ends fixed to the inner circumference of the outer rings 108*a* and 110*a* and front ends extending to the inner rings 108*b* and 110*b*, is illustrated as an example in the drawing, the reverse structure applying the sealing plates 126 having base ends fixed to the inner circumference of the inner rings 108*b* and 110 and front ends extending to the outer rings 108*a* and 110*a* is also possible. In this case, when seals are used as the sealing plates 126, the front ends of the seals 126 may be brought into contact with the other side raceway rings (namely, the outer rings 108 and 110*a* and the inner rings 108*b* and 110*b*), or small spaces may be kept without making contact therewith.

According to this modification, in addition to the results according to the above embodiments, by application of the respective ball bearings 108 and 110 and the sealing plates 126, the lubricant (more specifically, the grease for high speed bearings in Configuration Example 1 and the conductive grease in Configuration Example 2) sealing the internal spaces of the ball bearings 108 and 110 leaking out of the bearings and scattering may be reliably inhibited. This allows a long operating life of the spindle device since the rotating performance and lubrication property of the ball bearings 108 and 110 may be kept constant over a long period of time.

Figure 10:
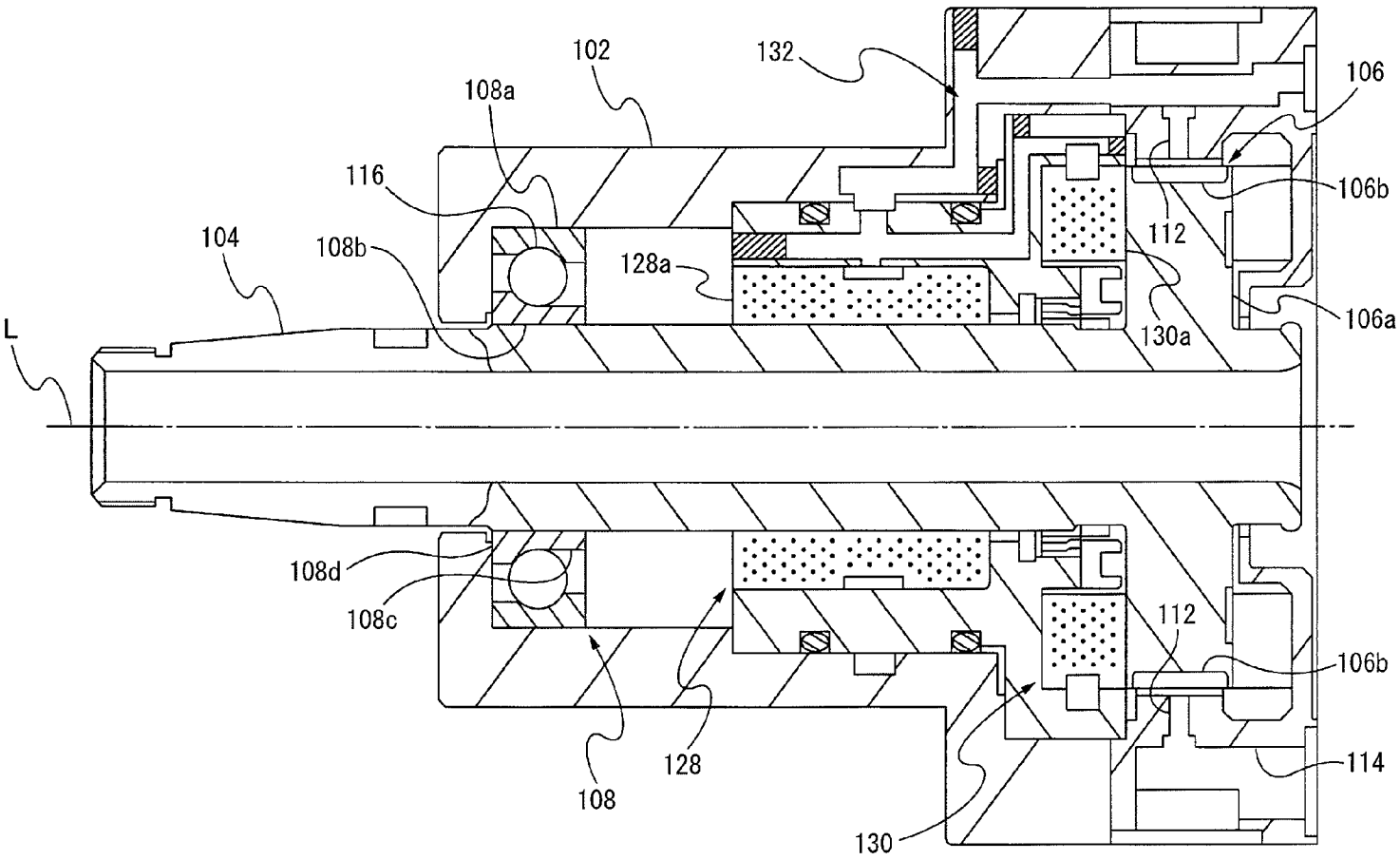
FIG. 10 is a cross-sectional view schematically illustrating an entire structure of a spindle device using an air motor according to another embodiment.

Alternatively, as illustrated in FIG. 10, for example, a structure having at least the ball bearings 108 on one side be ceramic roller bearings is possible. Note that while as an example in the drawing, the ball bearings 108 are provided between the housing 102 and the main shaft 104 such that back surfaces 108*d* of the inner rings 108*b* are pressed against the housing 102, this is not to limit the technical scope of the present invention.

In this case, type of bearings on the other end side is not particularly limited; however, as an example in the drawing, air bearings are applied, having a structure including radial air bearings 128, which radially support the main shaft 104 in the housing 102, and axial air bearings 130, which axially support the main shaft 104.

The radial air bearings 128 include hollow cylinder-shaped porous members 128*a*, which are arranged concentrically with the rotational axis L so as to cover the periphery of the man shaft 104, and the axial air bearings 130 include circular porous members 130*a*, which are placed facing each other along one side (one side along the length of the rotational axis L) of the turbine impeller 106*a* of the turbine drive member 106. Moreover, a compressed air channel 132 is established in the housing 102 for supplying compressed air to the porous members 128*a* and 130*a*, and a compressed air supply source not illustrated in the drawing is connected to the compressed air channel 132.

According to such air bearings, if air current such as compressed air is supplied to the compressed air channel 132 from the compressed air supply source, that air current passes through the respective porous members 128*a* and 130*a* and blown to the periphery of the main shaft 104 and one side of the turbine impeller 106*a*. At this time, a noncontact state is maintained between the main shaft 104 and the porous member 128*a*, and between the porous member 130*a* and one side of the turbine impeller 106*a* of the turbine drive member 106.

Since the ball bearings 108 on one end may radially and axially support the main shaft 104 on its own, the porous member 130*a* of the axial air bearings 130 do not need to be provided on either side so as to sandwich the turbine impeller 106*a* of the turbine drive member 106, where provision on only one side is sufficient. As a result, the main shaft 104 in its entirety including the turbine drive member 106 is supported by the ball bearings 108 on the one side in the housing 102, and is also supported by the air bearings 128 and 130 on the other end side floating above the housing 102.

According to this modification, in addition to the results according to the above embodiments, use of ceramic roller bearings as the ball bearings 108 on the one side and use of only the bearings on the other end side as the air bearings 128 and 130 may considerably reduce the number of the air bearings 128 and 130. This allows significant reduction in cost for operating the spindle device since air flow used for the air bearings 128 and 130 may be drastically decreased.

REFERENCE SIGNS LIST

2: main shaft
4: impeller
10: turbine blade
12: housing
14: bearing (radial static pressure gas bearing)
16: bearing (axial static pressure gas bearing)
28: nozzle (turbine air nozzle hole)
34: nozzle (brake air nozzle hole)

Description of Embodiments

The invention claimed is:

1. An air motor comprising:

a housing, a main shaft inserted inside of the housing, an impeller fixed concentrically with the main shaft to an inserted portion of the main shaft inside of the housing and having a plurality of turbine blades formed on an outer periphery, bearings for rotatably supporting the main shaft and the impeller in the housing, and at least one nozzle having a tubular or hole-shaped channel for ejecting compressed air to the respective turbine blades for rotating the impeller along a circumference, wherein when $M_1=v_e/a_0$ where $r_h$ denotes hydraulic radius of the channel of the nozzle, $c_f$ denotes viscous friction factor of a wall of the channel, k denotes specific heat ratio of compressed air, $v_e$ denotes flow velocity of the compressed air in an entrance of the channel, and $a_0$ denotes acoustic velocity, L is calculated using $$L = \frac{r_h}{2c_f}\left(\frac{1-M_1^2}{kM_1^2} + \frac{k+1}{2k}\ln\left(\frac{(k+1)M_1^2}{2+(k-1)M_1^2}\right)\right)$$

and the channel of the nozzle has a length set to a dimension of five or more than five times higher than the value of L and forty or less than forty times lower than the value L.

2. The air motor of claim 1, wherein the bearings are static pressure gas bearings.

3. The air motor of claim 1, wherein of the bearings, at least bearings on one end side are structured as ceramic roller bearings.

4. The air motor of claim 3, wherein the roller bearings comprise a raceway ring on one side mounted on the housing, and a raceway ring on the other side mounted on a spindle facing the raceway ring on the one side, and a plurality of rolling elements incorporated between the raceway rings, and either the raceway rings or the rolling elements or all of them are made of ceramics.

5. The air motor of claim 4, wherein either the raceway rings or the rolling elements or all of them are made of non-conducting ceramics.

6. The air motor of claim 4, wherein the raceway rings and the rolling elements are made of non-conducting ceramics.

7. An electric painting device comprising the air motor according to claim 1.

* * * * *